US009931834B2

(12) United States Patent
Osakabe

(10) Patent No.: US 9,931,834 B2
(45) Date of Patent: Apr. 3, 2018

(54) PRINTING APPARATUS, PRINTING CONTROL METHOD AND MEMORY MEDIUM

(71) Applicant: CASIO COMPUTER CO., LTD., Tokyo (JP)

(72) Inventor: Fumihiro Osakabe, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 4 days.

(21) Appl. No.: 15/145,550

(22) Filed: May 3, 2016

(65) Prior Publication Data

US 2016/0368264 A1 Dec. 22, 2016

(30) Foreign Application Priority Data

Jun. 19, 2015 (JP) ..... 2015-124278

(51) Int. Cl.

*B41J 2/045* (2006.01)
*B41J 2/165* (2006.01)
*B41J 3/407* (2006.01)

(52) U.S. Cl.

CPC ..... *B41J 2/04508* (2013.01); *B41J 2/0451* (2013.01); *B41J 2/04586* (2013.01); *B41J 2/16508* (2013.01); *B41J 2/16526* (2013.01); *B41J 2/16588* (2013.01); *B41J 3/4078* (2013.01)

(58) Field of Classification Search

CPC B41J 2/04508; B41J 2/16588; B41J 2/16508; B41J 2/16526; B41J 2/0451; B41J 2/04586; B41J 3/4078

See application file for complete search history.

(56) References Cited

U.S. PATENT DOCUMENTS

2001/0055044 A1* 12/2001 Matsumoto ..... B41J 2/16585 347/35

FOREIGN PATENT DOCUMENTS

| | | | |
|---|---|---|---|
| CN | 103522754 | A | 1/2014 |
| JP | 2000-127456 | A | 5/2000 |
| JP | 2002-79686 | A | 3/2002 |
| JP | 3334913 | B2 | 8/2002 |
| JP | 2003-305874 | A | 10/2003 |

OTHER PUBLICATIONS

Chinese Office Action dated Jun. 21, 2017, issue in corresponding Chinese Patent Application No. 201610440275.6 and English translation of the same. (15 pages).

* cited by examiner

*Primary Examiner* — Henok Legesse
(74) *Attorney, Agent, or Firm* — Fitch Even Tabin & Flannery LLP

(57) ABSTRACT

A printing control method for a printing apparatus that includes a controller, such that the controller:

sets a plurality of first regions along a first direction on a print medium that is conveyed, and a plurality of second regions between two first regions of the plurality of first regions, on the basis of print data; and causes ink to be discharged from a print head to the plurality of first regions so as to print on the basis of the print data and also causes ink to be discharged from the print head to the second region determined on the basis of an indicator value for predicting poor discharging of ink in the print head.

17 Claims, 10 Drawing Sheets

PRINTING START POSITION
FIRST
SECOND
THIRD
FOURTH
FIFTH
160
165
ABCDE
P
Q
3
X
Y
Z

NOZZLE DRYNESS
THRESHOLD VALUE R
SECTIONS 1, 3
SECTION 2
TIME
0
T1
T2

PRINTING START POSITION
FIRST
SECOND
THIRD
FOURTH
FIFTH
160
165
ABCDE
P
Q
S1
S2
3
X
Y
Z

NOZZLE DRYNESS
THRESHOLD VALUE R
SECTIONS 1, 3
SECTIONS 2
TIME
0
T3
T4

PRINTING APPARATUS, PRINTING CONTROL METHOD AND MEMORY MEDIUM

CROSS-REFERENCE TO RELATED APPLICATION

This application is based upon and claims the benefit of priority from the prior Japanese Patent Application No. 2015-124278 filed on Jun. 19, 2015, and the entire contents of which are incorporated herein by reference.

FIELD

This application relates generally to a printing apparatus, a printing control method and a memory medium.

BACKGROUND

An inkjet-type printing apparatus that executes printing by discharging ink from a print head onto a printing medium has been known from before. In an inkjet-type printing apparatus, when ink inside a plurality of nozzles with which the print head is equipped is exposed to air, the ink hardens or solidifies as a result of drying, increased viscosity and/or the like of the ink, causing clogging of the nozzles. When nozzle clogging occurs, ink is not properly discharged from the nozzle, resulting in a drop in printing quality.

In order to prevent exposure of ink inside the nozzle to the air, in many cases the nozzles of the print head are stored covered with a cap during non-printing times (when in print standby). However, when printing begins, in some cases ink is not discharged for a long time and is exposed to the air, depending on the nozzle. Consequently, cases arise in which avoiding poor discharging of ink resulting from nozzle clogging is difficult.

As a countermeasure to this kind of nozzle clogging, Patent Literature 1, for example, discloses an inkjet recording apparatus provided with a configuration that preliminarily discharges ink to the outside of a recording region (printing region) of an image. The recording apparatus disclosed in Japanese Patent No. 3334913 improves poor discharging of ink caused by nozzle clogging by preliminarily discharging (spraying) ink that is the source of nozzle clogging (waste ink) from the nozzle with a timing prior to printing and/or the like.

SUMMARY

However, when the print head is moved from the printing position in order to discharge waste ink, time is needed to move the print head. Consequently, this becomes an impediment to high-speed printing. In particular, when executing lengthy printing such as when executing printing continuously over multiple printing regions, the need arises for waste ink to be discharged any number of times during printing, so printing time increases greatly.

In order to resolve the above-described problems, an object of the present application is to provide a printing apparatus, printing control method and recording medium that enable high-speed printing while controlling poor discharging of ink.

In order to achieve the above-described object, the present application is a printing control method for a printing apparatus that includes a controller, such that the controller:

sets a plurality of first regions along a first direction on a print medium that is conveyed, and a plurality of second regions between two first regions of the plurality of first regions, on the basis of print data; and causes ink to be discharged from a print head to the plurality of first regions so as to print on the basis of the print data and also causes ink to be discharged from the print head to the second region determined on the basis of an indicator value for predicting poor discharging of ink in the print head.

The present application is a printing apparatus comprising:

a print head and a controller, wherein the controller:

sets a plurality of first regions along a first direction on a print medium that is conveyed, and a plurality of second regions between two first regions of the plurality of first regions, on the basis of print data; and causes ink to be discharged from the print head to the plurality of first regions so as to print on the basis of the print data and also causes ink to be discharged from the print head to the second region determined on the basis of an indicator value for predicting poor discharging of ink in the print head.

The present application is a non-transitory computer-readable memory medium for controlling a printing apparatus comprising a controller, the memory medium causing the following to be accomplished:

a process that sets a plurality of first regions along a first direction on a print medium that is conveyed, and a plurality of second regions between two first regions of the plurality of first regions, on the basis of print data; and a process that causes ink to be discharged from a print head to the plurality of first regions so as to print on the basis of the print data and also causes ink to be discharged from the print head to the second region determined on the basis of an indicator value for predicting poor discharging of ink in the print head.

BRIEF DESCRIPTION OF THE DRAWINGS

A more complete understanding of this application can be obtained when the following detailed description is considered in conjunction with the following drawings, in which.

DETAILED DESCRIPTION

Figure 1:
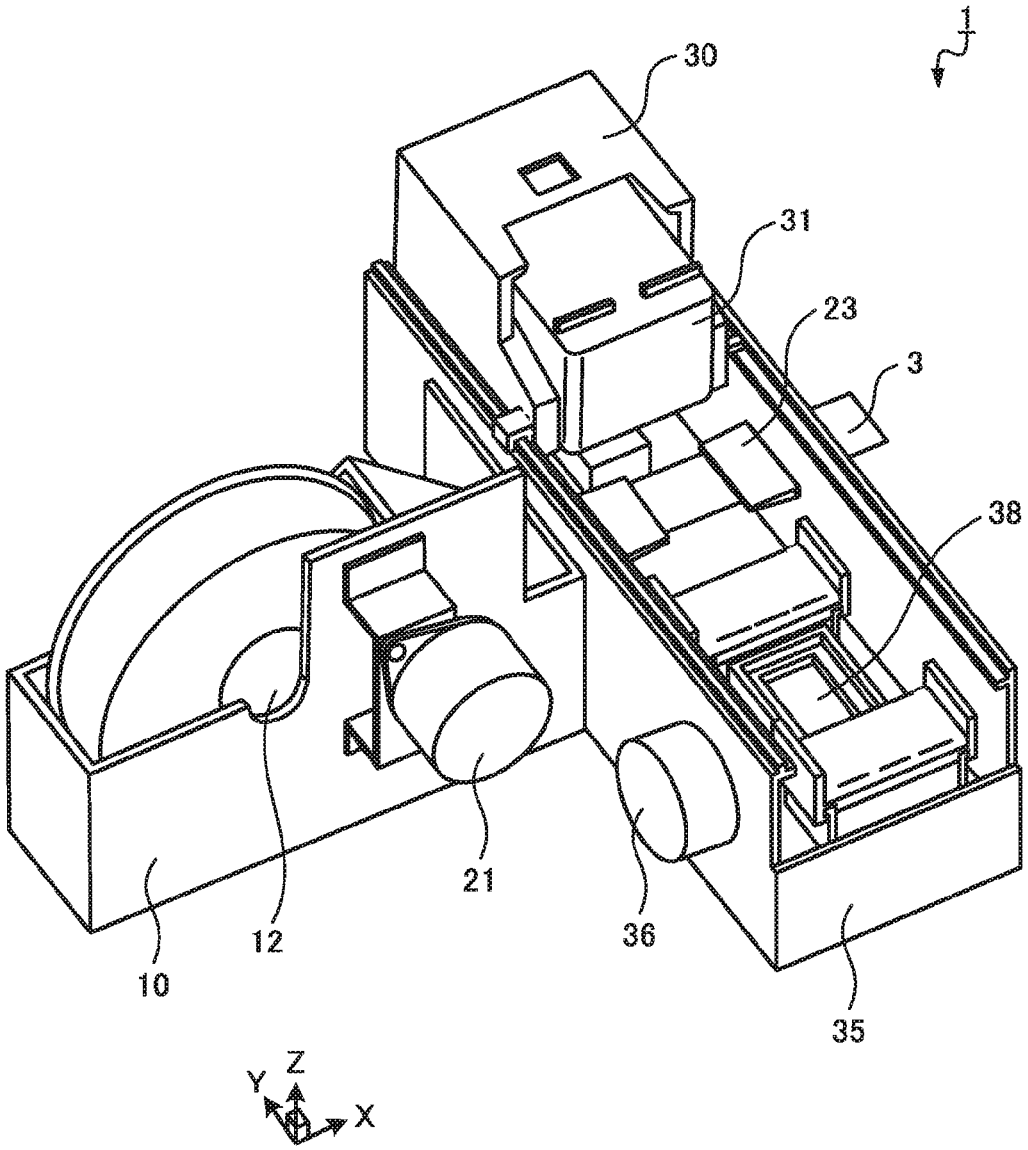
FIG. 1 is an oblique view showing an internal configuration of a printing apparatus according to an exemplary embodiment of the present disclosure.

Below, an exemplary embodiment of the present disclosure is described with reference to the drawings. Same or corresponding portions in the drawings are labeled with the same reference symbols.

FIG. 1 shows an internal configuration of a printing apparatus 1 according to an exemplary embodiment of the present disclosure. The printing apparatus 1 is provided with a configuration such as that shown in FIG. 1, inside an unrepresented housing.

The printing apparatus 1 is a so-called inkjet printer, and is an inkjet-type printer that prints a print pattern including patterns of pictures, characters and/or the like on a long printing medium, using a method in which ink is turned into fine droplets and sprayed directly onto a printing medium (recording medium).

The X direction shown in FIG. 1 is the direction in which a tape member 3 is conveyed. The Y direction is the direction of width of the conveyed tape member 3. The Z direction is the direction ink is discharged (sprayed) onto the tape member 3 from the print head. The settings of the X, Y and Z directions are the same in the below-described drawings as well.

As shown in FIG. 1, the printing apparatus 1 comprises a tape holder 10, an ink carriage (ink cartridge holder) 30, an ink cartridge (ink tank) 31 and a carriage conveyor 35.

The tape holder 10 houses the tape member 3 in a state wound into a roll about a tape core 12. The tape member 3 is a printing medium formed by accumulating a printing tape the front surface of which is a printing surface and the rear surface of which is an adhesive surface, and release tape adhered to the adhesive surface.

Figure 2:
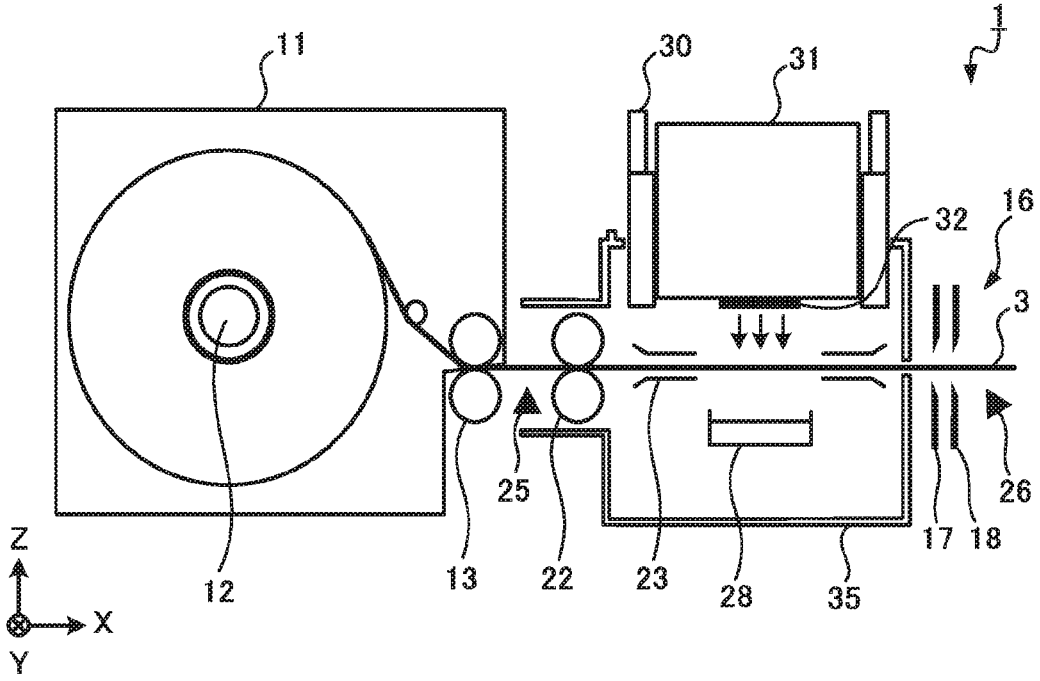
FIG. 2 is a cross-sectional view of the internal configuration of the printing apparatus.

FIG. 2 shows the state of the printing apparatus 1 when viewed from the side (Y direction). As shown in FIG. 2, the tape member 3 is housed in the tape holder 10 in a state mounted in a tape cartridge 11. The tape cartridge 11 is a vessel in which is mounted the tape member 3 in a state wound about the tape core 12. In order to facilitate understanding, the tape cartridge 11 is omitted in FIG. 1.

The tape holder 10 can house (load) the tape cartridge 11, on which various types of tape member 3 of differing widths, colors and/or the like can be mounted, with the tape cartridge 11 housed in an interchangeable state. That is to say, a user can interchange the tape cartridge 11 housed in the tape holder 10, and through this can accomplish printing on various types of tape members 3.

As shown in FIG. 2, an automatic sheet feeder (ASF) roller 13 is provided in a tape feed opening of the tape cartridge 11. The ASF roller 13 is a feed roller for feeding the tape member 3 housed inside the tape cartridge 11 to the outside. When printing is commanded in a state with the tape cartridge 11 set in the tape holder 10, the ASF roller 13 is driven by a driving force accompanying rotation of a driver gear (omitted in drawing). Through this, the ASF roller 13 rotates at a prescribed rotational speed and sends the tape member 3 housed in the tape cartridge 11 to a platen roller 22.

The platen roller 22 is a tape conveyor mechanism (main roller) for conveying the tape member 3 housed in the tape cartridge 11. The platen roller 22 sandwiches and conveys the tape member 3 sent out by the ASF roller 13 from inside the tape cartridge 11, and supplies the tape member 3 to a conveyance guide 23. By rotating forward, the platen roller 22 can send out the tape member 3, and by rotating in reverse, can rewind the tape member 3.

At least one roller gear (omitted in drawing) is integrally attached to the end of a rotation shaft of the platen roller 22. Via the roller gear, the platen roller 22 is connected to a stepping motor 21. A driving force accompanying rotation of a driver gear (omitted in drawing) attached to a driver shaft of the stepping motor 21 is transferred to the roller gear through a plurality of driver gears, and through this the platen roller 22 rotates at a prescribed rotational speed.

The ink carriage (ink cartridge holder) 30 comprises the ink cartridge (ink tank) 31 and a print head 32 (inkjet head) that discharges ink with which the ink cartridge 31 is filled.

The print head 32 is a printing mechanism that discharges the ink with which the ink cartridge 31 is filled and executes printing on the tape member 3. In the print head 32, a plurality of nozzles is arranged along the width direction (Y direction) and the conveyance direction (X direction) of the tape member 3. Ink in the plurality of nozzles bubbles when headed by a heater, and through the bubbles that form, the ink is discharged from each of the plurality of nozzles toward the tape member 3 (the −Z direction). Through this kind of principle, the print head 32 prints a print pattern on the tape member 3.

As one example, a resolution of the print head 32 is 0.0423 mm per dot. In addition, the effective printing width of the print head 32 is 14 mm. The length of the print head 32 in the widthwise direction (Y direction) of the tape member 3 is set so as to be longer than the width of the tape member 3. That is to say, the print head 32 prints a print pattern on the tape member 3 with one pass per line (single pass method).

The carriage conveyor 35 is a conveyance mechanism for causing the ink carriage 30 to move to the left and right (Y direction). The carriage conveyor 35 is provided with a carriage belt set along the Y direction, and the ink carriage 30 is mounted on this carriage belt. The carriage belt is connected to a stepping motor 36. Furthermore, the ink carriage 30 can be caused to move back and forth between a print standby position, a printing position and a waste ink position through driving of the stepping motor 36.

Figure 3:
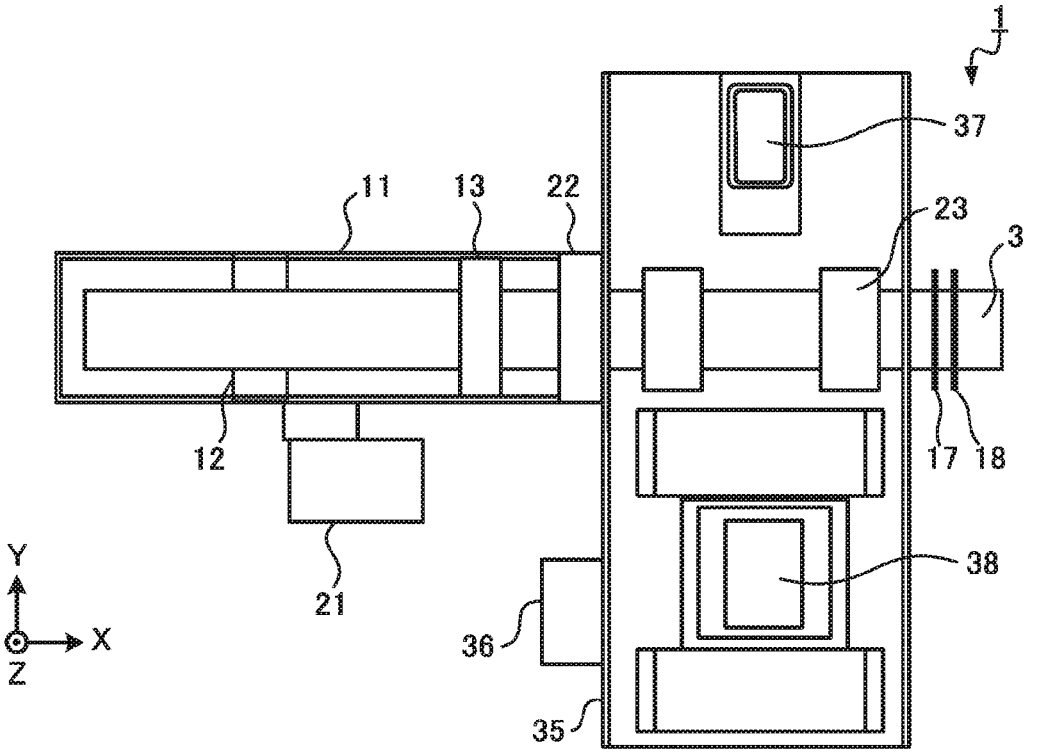
FIG. 3 is a planar view of the internal configuration of the printing apparatus.

FIG. 3 shows the state of the internal configuration of the printing apparatus 1 when viewed from above. In FIG. 3, the configuration of the ink carriage 30 and the ink cartridge 31 and/or the like are appropriately omitted in order to facilitate understanding. As shown in FIG. 3, on the bottom side of the path over which the ink carriage 30 moves in the carriage conveyor 35, a cap 37 and a waste ink receptacle (ink absorber) 38 are provided.

The cap 37 is a member that seals the discharge opening of the nozzle in order to control poor discharging of ink from the print head 32. That is to say, when the discharge opening of the nozzle is exposed to the air, the ink solidifies or hardens due to dryness or increased viscosity and/or the like of the ink, causing nozzle clogging. In order to avoid this, at normal standby times (non-printing times), the ink carriage 30 is at the position of the cap 37 (home position), as shown in FIG. 1, and is in a state with the cap 37 covering the ink discharge opening of the nozzle so that the print head 32 does not dry out.

Figure 4:
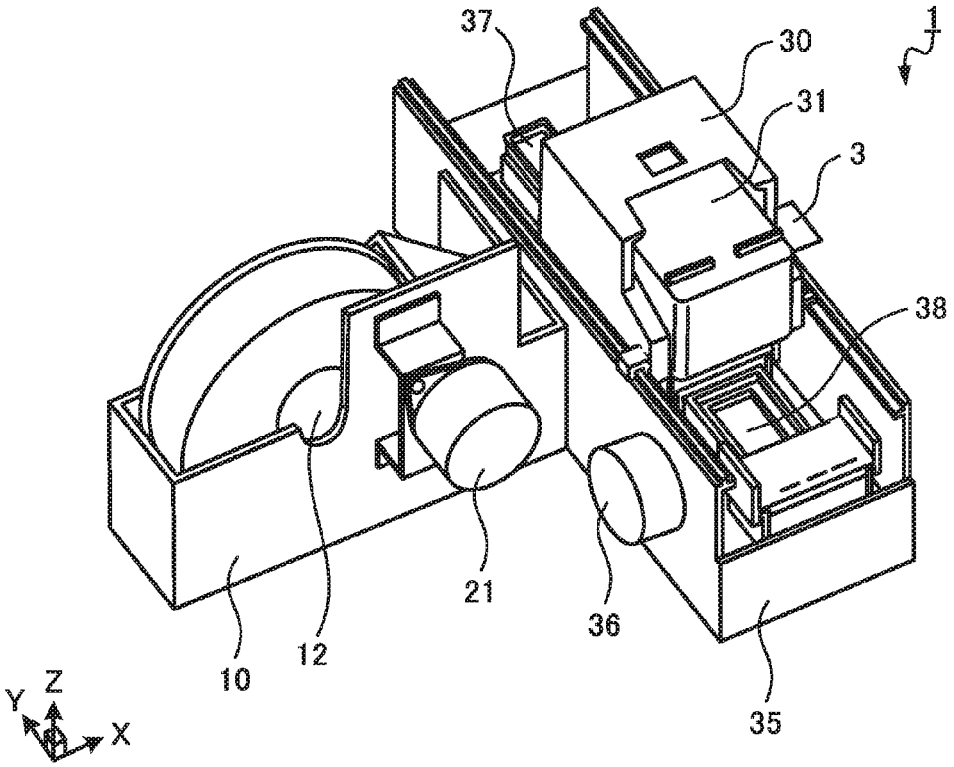
FIG. 4 is an oblique view showing the internal configuration of the printing apparatus when an ink cartridge is in a printing position.

In contrast, at printing times, the ink carriage 30 is driven by the carriage conveyor 35 and moves to above the tape member 3, as shown in FIG. 4. That is to say, the carriage conveyor 35, when printing is commanded, causes the ink carriage 30 to move from the printing standby position where the cap 37 is to a printing position above the tape member 3.

Figure 5:
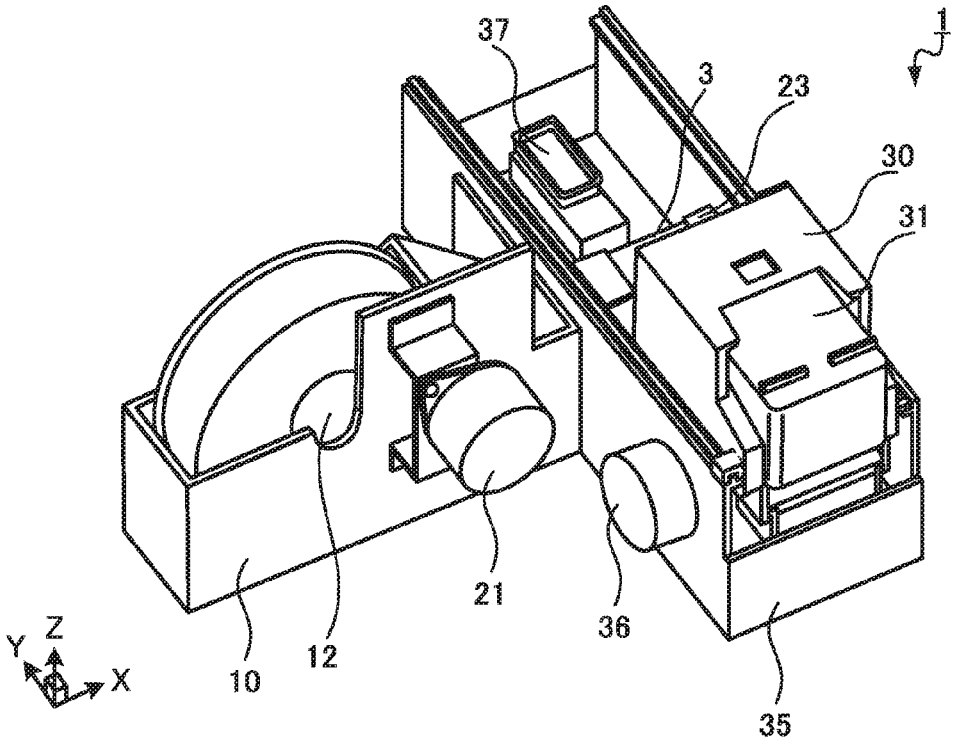
FIG. 5 is an oblique view showing the internal configuration of the printing apparatus when the ink cartridge is in a spit position.

Furthermore, at least with a timing immediately prior to printing, the ink carriage 30 is driven by the carriage conveyor 35 and moves to above a waste ink receptacle 38, as shown in FIG. 5. The waste ink receptacle 38 is a member that absorbs waste ink discharged from the print head 32. Here, waste ink is ink that is the source of poor discharge from the nozzle provided in the print head 32, and thus is discarded without being used in printing.

That is to say, even when closed by the cap 37, the ink of the print head 32 hardens or solidifies with the passing of time, causing poor discharge of ink. In order to avoid this, the ink carriage 30 moves to above the waste ink receptacle 38 prior to printing, discharges the waste ink to the waste ink receptacle 38, cleans the nozzle and then prints. Through this, printing quality is stabilized.

Let us return to a description of the cross-sectional view of the printing apparatus 1 as seen from the side (Y direction) shown in FIG. 2. The conveyance guide 23 is a guide for correctly guiding the tape member 3 to a printing position by the print head 32, and forms a tape conveyance path. In addition, on the bottom side of the tape conveyance path at the printing position, an ink receptacle (ink absorber) 28 is positioned for receiving ink that does not adhere to the tape member 3 out of the ink discharged from the print head 32.

An end edge detection sensor 25 and a starting edge detection sensor 26 are reflective optical sensors having light-emitting elements for emitting light toward the back surface of the tape member 3, and light-receiving elements for receiving light reflected upon striking the back surface of the tape member 3 that is the sensor target.

The end edge detection sensor 25 is positioned in advance of the printing position in the tape conveyance route, and detects that the end edge (tail end) of the tape member 3 has reached the position of the end edge detection sensor 25. Through this, the fact that the tape member 3 housed in the tape holder 10 has run out is detected. In contrast, the starting edge detection sensor 26 is positioned on the back side from the printing position in the tape conveyance path, and detects that the starting edge (leading edge) of the tape member 3 has reached the position of the starting edge detection sensor 26. Detection of the starting edge of the tape member 3 in this manner is a criterion for determining the printing start position and/or the like.

The tape member 3 on which a print pattern is printed is fed out to the outside of the housing of the printing apparatus 1 from a tape feeder 16. In the tape feeder 16, a full-cut mechanism 17 is included as full cutter that cuts the printing tape and the release tape of the tape member 3 in a sideways direction, and a half-cut mechanism 18 is included as a half cutter that cuts only the printing tape of the tape member 3 and does not cut the release tape. When printing ends, depending on the settings the full-cut mechanism 17 or the half-cut mechanism 18 acts and cuts the tape member 3 in the sideways direction, creating one tape-like label.

Figure 6:
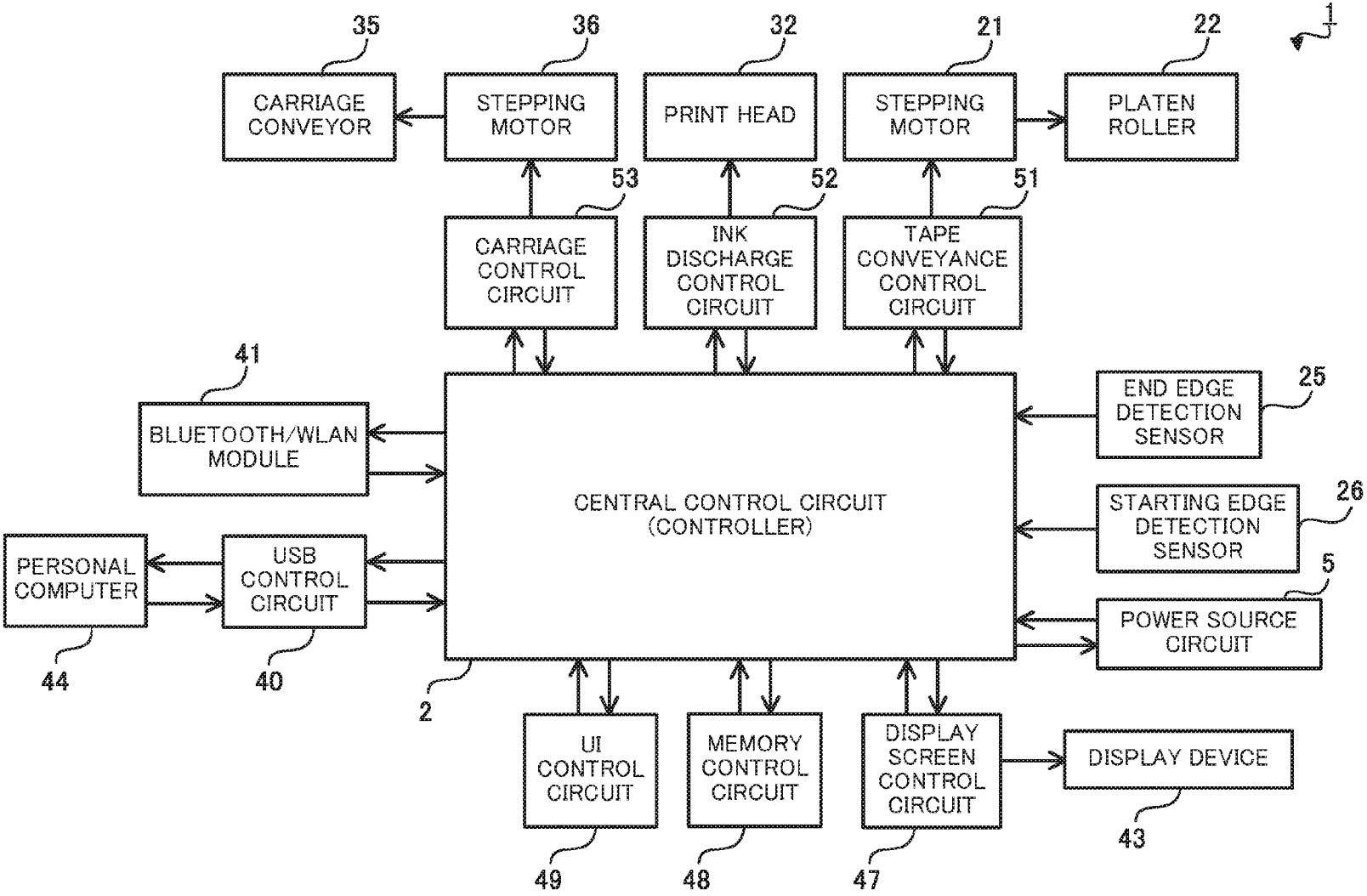
FIG. 6 is a block diagram showing a configuration according to control of the printing apparatus.

FIG. 6 shows a configuration relating to control of the printing apparatus 1.

The printing apparatus 1 comprises a central control circuit (controller) 2, a power source circuit 5, a universal serial bus (USB) control circuit 40, a Bluetooth® module/wireless local area network (WLAN) module 41, a display device 43, a display screen control circuit 47, a memory control circuit 48, a user interface (UI) control circuit 49, a tape conveyance control circuit 51, an ink discharge control circuit 52 and a carriage control circuit 53.

The central control circuit 2 (hereafter referred to as the controller 2) is a circuit that includes a central processing unit (CPU, controller). The controller 2 is connected to each of the circuits in the printing apparatus 1 via a bus, and comprehensively controls the entire system of the printing apparatus 1. In FIG. 6, most of the circuits are connected to only the controller 2, but each of the circuits can also communicate data with each other via a bus.

The power source circuit 5 comprises a power source integrated circuit (IC) and/or the like, and creates and supplies the necessary power to each of the circuits. For example, the tape conveyance control circuit 51, the ink discharge control circuit 52, the carriage control circuit 53 and/or the like each operate after obtaining electric power from the power source circuit 5.

The tape conveyance control circuit 51 comprises a motor driver that controls driving of the stepping motor 21, and controls conveyance of the tape member 3. The tape conveyance control circuit 51 receives a driving signal output from the controller 2, and supplies electric power for driving to the stepping motor 21. By counting the number of pulses of a driving signal output to the stepping motor 21, the tape conveyance control circuit 51 determines how much the stepping motor 21 has been caused to rotate. Furthermore, the tape conveyance control circuit 51 determines the conveyance distance of the tape member 3 on the basis of this number of rotations. The stepping motor 21 uses 1-2 phase excitation driving, and has a gear ratio configured such that there is one step per line (0.0423 mm), for example.

The end edge detection sensor 25 and the starting edge detection sensor 26 are connected to the controller 2. The end edge detection sensor 25 and the starting edge detection sensor 26 output a signal to the controller 2 in accordance with the amount of light received in the light-receiving element. The tape conveyance control circuit 51, by receiving from the controller 2 a detection signal in the end edge detection sensor 25 and the starting edge detection sensor 26, acquires information relating to the tape member 3, such as the absence or presence of the tape member 3 housed in the tape holder 10, the printing position of the tape member 3, and/or the like. For example, when the starting edge of the tape member 3 is detected by the starting edge detection sensor 26, the tape conveyance control circuit 51 sets the starting edge of the tape member 3 in a printing start position, by causing the platen roller 22 to rotate in reserve a stipulated number of steps.

The ink discharge control circuit 52 controls discharging of ink from the print head 32 during printing. The ink discharge control circuit 52 receives print data (image data indicating the image to be printed) and a print signal output from the controller 2, and controls electric current dots of the print head 32 at the driver IC provided internally. Through this, the ink discharge control circuit 52 causes the print head to discharge ink and causes printing to be accomplished.

The carriage control circuit 53 is provided with a motor driver for controlling driving of the stepping motor 36, and controls conveyance of the ink carriage 30 in the carriage conveyor 35. The carriage control circuit 53 receives a driver signal output from the controller 2, and supplies electric power for driving to the stepping motor 36. The carriage control circuit 53 determines how much the stepping motor 36 has rotated by counting the number of pulses of the driver signal output to the stepping motor 36. Furthermore, the carriage control circuit 53 determines the conveyance distance of the ink carriage 30, based on the number of rotations.

The display screen control circuit 47 controls data transfers to the display device 43 and turning on and extinguishing of the backlight.

The display device 43 is a display apparatus provided for example with a liquid crystal display (LCD) and/or the like.

The memory control circuit 48 is provided with and controls a read-only memory (ROM) such as NAND-type flash memory that stores programs and data, a random access memory (RAM) such as a double data rate (DDR) memory that temporarily stores programs and data, and/or the like.

The UI control circuit 49 receives manipulation input from an input device such as a keyboard, mouse, remote control, button, touch panel and/or the like, and supplies the manipulation input information received to the controller 2.

The USB control circuit 40 controls communication through a USB between a personal computer (PC) 44 and the printing apparatus 1. The PC 44 sends print data and/or the like to the printing apparatus 1 via the USB control circuit 40.

The Bluetooth® module/WLAN module 41 is a module for enabling the printing apparatus 1 to wirelessly communicate with external equipment. A user can transmit various types of data to the printing apparatus 1 via a mobile terminal, through short-range wireless communication such as Bluetooth® and/or the like. In addition, the PC 44 may also send print data and/or the like to the printing apparatus 1 via the Bluetooth® module/WLAN module 41 instead of the USB control circuit 40.

Figure 7:
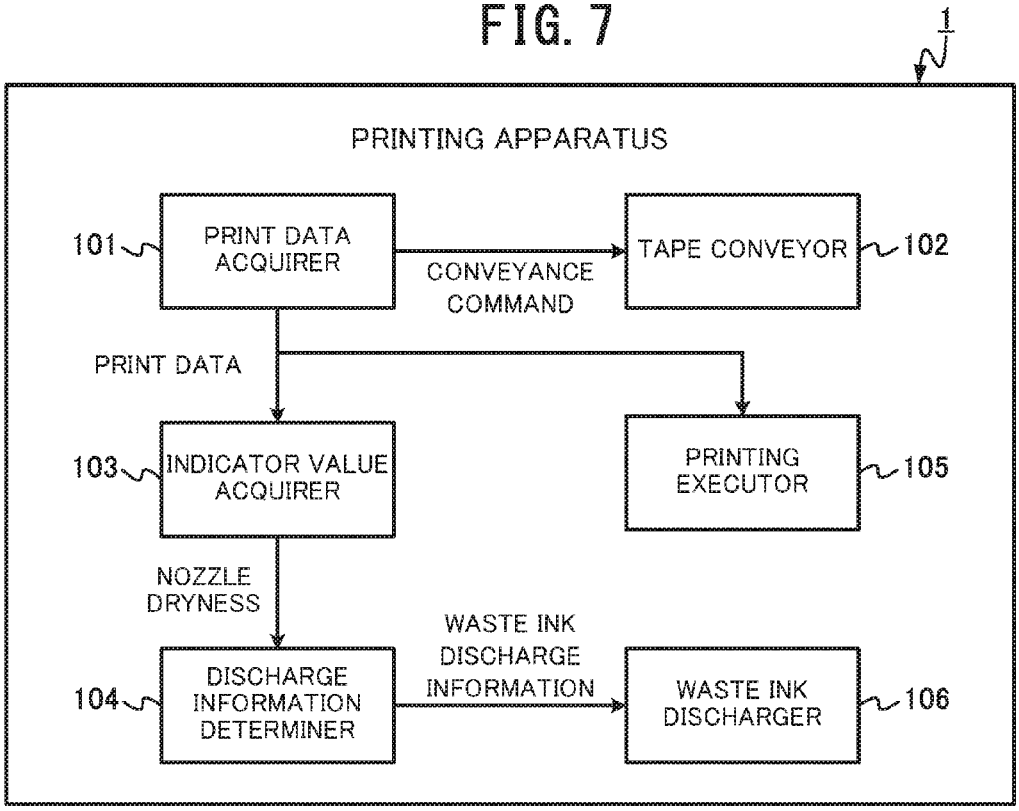
FIG. 7 is a block diagram showing a functional configuration of the printing apparatus.

FIG. 7 shows a functional configuration of the printing apparatus 1. The printing apparatus 1 comprises a print data acquirer 101, a tape conveyor 102, an indicator value acquirer 103, a discharge information determiner 104, a printing executor 105 and a waste ink discharger 106. The controller 2 reads out a program stored in the ROM to the RAM, and functions as each of the above-mentioned components by executing this program and accomplishing control.

The print data acquirer 101 acquires print data that should be printed on the tape member 3. The print data is data that includes information such as image data indicating a print pattern to be depicted on the print surface of the tape member 3, the number of printings, the vertical and horizontal print size on the print screen, and/or the like. The print data is created by receiving manipulation instructions from the user via a print driver installed in advance in the PC 44, for example.

Figure 8:
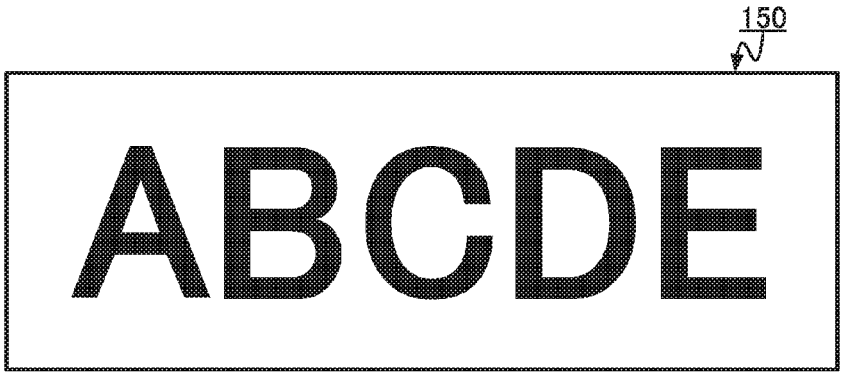
FIG. 8 is a drawing showing an example of a print pattern.

FIG. 8 shows an example of a print pattern 150 included in the print data. The print data acquirer 101 acquires print data including the print pattern 150 expressing the character string "ABCDE" as shown in FIG. 8, for example, from the PC 44 via the USB control circuit 40, the Bluetooth® module/WLAN module 41 and/or the like. In this manner, the print data acquirer 101 is realized by the controller 2 working together with the USB control circuit 40, the Bluetooth® module/WLAN module 41 and/or the like. The print data acquirer 101, upon acquiring print data, sends the acquired print data to the printing executor 105 and the indicator value acquirer 103, and sends a conveyance command for the tape member 3 to the tape conveyor 102.

The tape conveyor 102 conveys the tape member 3 that is the printing medium in the lengthwise direction (that is to say, the X direction) of the tape member 3. To explain more concretely, the tape conveyor 102 feeds the tape member 3 housed wound in a rolled state in the tape holder 10 through the ASF roller 13. Furthermore, the tape conveyor 102 conveys the fed-out tape member 3 at a predetermined speed by the platen roller 22, and sends the tape member 3 to a print position through the print head 32. In this manner, the tape conveyor 102 is realized by the tape conveyance control circuit 51 working together with the stepping motor 21, the ASF roller 13 and the platen roller 22, under control of the controller 2. The tape conveyor 102 is one example of conveyance means.

The indicator value acquirer 103 acquires an indicator value for predicting the occurrence of poor discharging of ink in cases when the printing executor 105 executes printing, in advance of the printing executor 105 starting printing. The discharge information determiner 104 determines a second region where the waste ink discharger 106 discharges waste ink, and the amount of ink to be discharged in the second region, on the basis of the indicator value acquired by the indicator value acquirer 103. This kind of indicator value acquirer 103 and discharge information determiner 104 are realized by the controller 2 working together with the memory control circuit 48 and/or the like. The indicator value acquirer 103 is one example of indicator value acquisition means, and the discharge information determiner 104 is one example of determination means.

The printing executor 105 executes printing by discharging ink from the print head 32 to a plurality of first regions (regions for printing the print data) lined up in the lengthwise direction (the X direction) on the tape member 3 conveyed by the tape conveyor 102. The printing executor 105 is realized by the ink discharge control circuit 52 working together with the print head 32, under control of the controller 2. The printing executor 105 is one example of ink discharge means.

The waste ink discharger 106 discharges ink (waste ink) from the print head 32 in a second region determined by the discharge information determiner 104, so that poor discharging of ink does not occur in the print head 32 when the printing executor 105 executes printing, the second region being between two adjacent first regions 160 out of a plurality of first regions 160. The waste ink discharger 106 is realized by the ink discharge control circuit 52 working together with the print head 32, under control of the controller 2. The waste ink discharger 106 is a different example of the ink discharge means.

Below, the various functions of the indicator value acquirer 103, the discharge information determiner 104, the printing executor 105 and the waste ink discharger 106 are described more concretely, with reference to FIG. 9 through FIG. 12.

Figure 9:
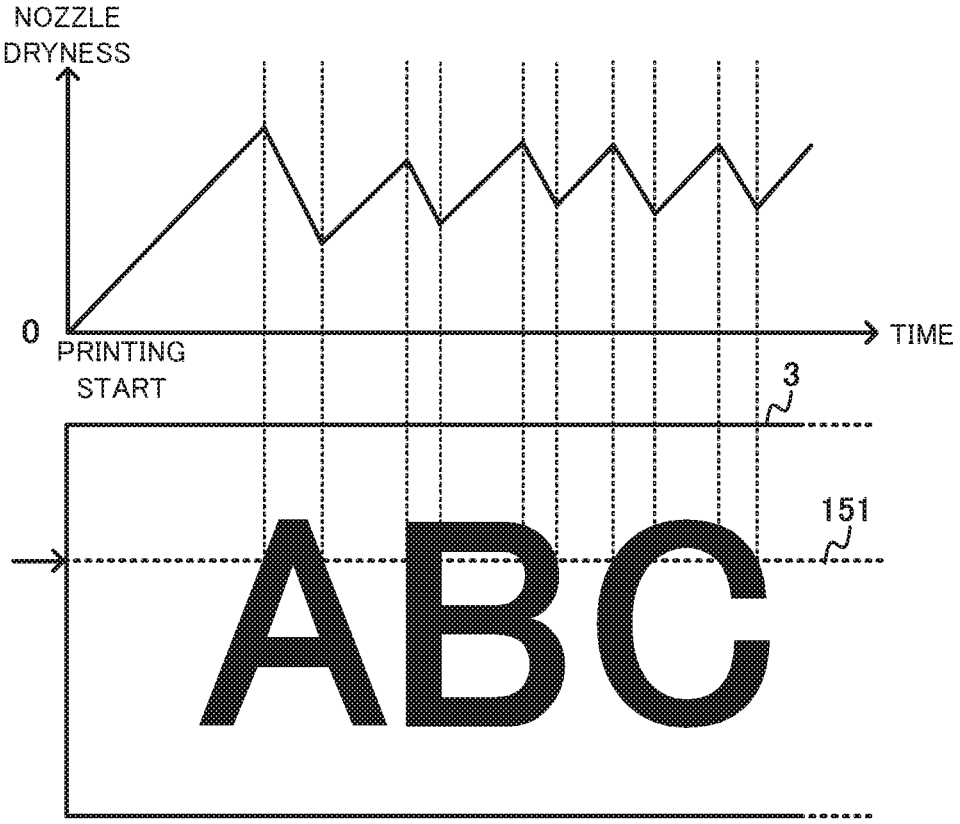
FIG. 9 is a drawing showing an example of acquiring nozzle dryness.

The indicator value acquirer 103 computes, as an indicator value, a nozzle dryness indicating the degree of dryness of the multiple nozzles provided in the print head 32. FIG. 9 shows an example of computing nozzle dryness, in a case in which the print pattern 150 was printed on the tape member 3. The nozzle dryness on a printing line 151 indicated by an arrow and dotted line in FIG. 9, out of the print pattern 150 printed on the tape member 3, changes with time as shown in the graph at the top in FIG. 9.

A more detailed description of FIG. 9 will be given. During the interval from the start of printing until the printing position reaches the initial character "A" of the print pattern 150, ink is not discharged onto the printing line 151.

In this case, the discharge opening of the nozzle that discharges ink onto this printing line 151, out of the plurality of nozzles provided in the print head 32, is exposed to the air. Consequently, the nozzle dryness increases steadily with the passing of time (by a set value determined per unit time). In contrast, when the printing position reaches the character "A", ink is discharged onto the printing line 151 and the character "A" is drawn. In this case, the discharge opening of the nozzle discharging ink onto the printing line 151 is in a state with ink flowing. Consequently, the nozzle dryness decreases steadily with the passing of time (by a set value determined per unit time). In this manner, the indicator value acquirer 103 determines as the nozzle dryness a value that decreases when ink is being discharged from the print head 32 and increases when ink is not being discharged from the print head 32, in the middle of the printing executor 105 executing printing. That is to say, the nozzle dryness is determined through the print data.

As this kind of nozzle dryness, the indicator value acquirer 103 acquires the change with time in the nozzle dryness in a case in which the printing executor 105 executes printing in the first region without the waste ink discharger 106 discharging ink, respectively in three sections divided in the second (widthwise) direction (Y direction) of the tape member 3, on the tape member 3. Furthermore, the discharge information determiner 104 determines, for each of the three sections, the second region where the waste ink discharger 106 discharges waste ink and the amount of waste ink that the waste ink discharger 106 discharges in this second region, on the basis of the change with time of the nozzle dryness acquired respectively for each of the three sections by the indicator value acquirer 103.

Figure 10:
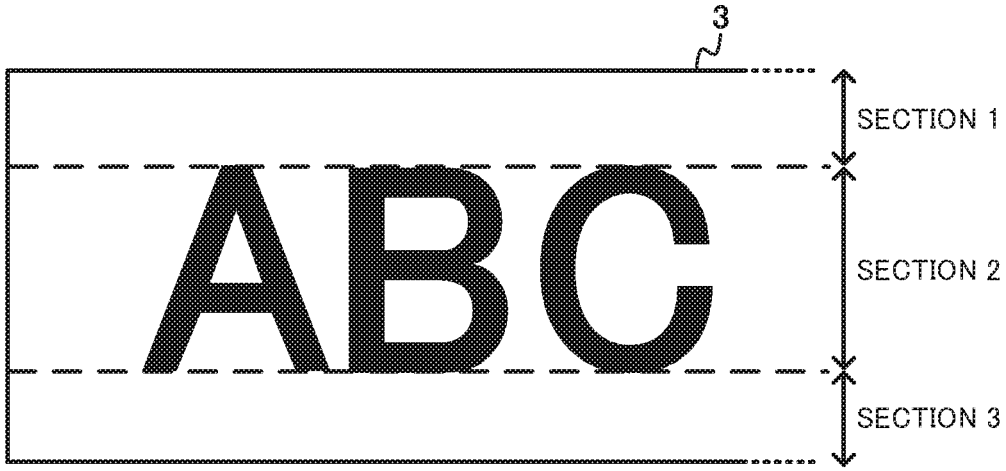
FIG. 10 is a drawing showing an example of three partitions on a tape member.

Specifically, as shown in FIG. 10, the indicator value acquirer 103 divides the region on the tape member 3 into a section 1 and a section 3 corresponding to the blank space on both edges in the second direction, and a section 2 corresponding to part where the print pattern 150 is printed in the center. On top of this, the indicator value acquirer 103 acquires the change with time of the nozzle dryness in each of the three divided sections. More specifically, the indicator value acquirer 103 acquires, as the change with time in the nozzle dryness of each section, the change with time in the dryness of a representative nozzle out of the plurality of nozzles included in each of the three sections, or the change with time in an average value in the second (widthwise) direction (Y direction) of the dryness of the plurality of nozzles contained in each of the three sections, or the change in time of a maximum value in the second (widthwise) direction (Y direction) of the dryness of the plurality of nozzles contained in each of the three sections.

Figures 11A, 11B:
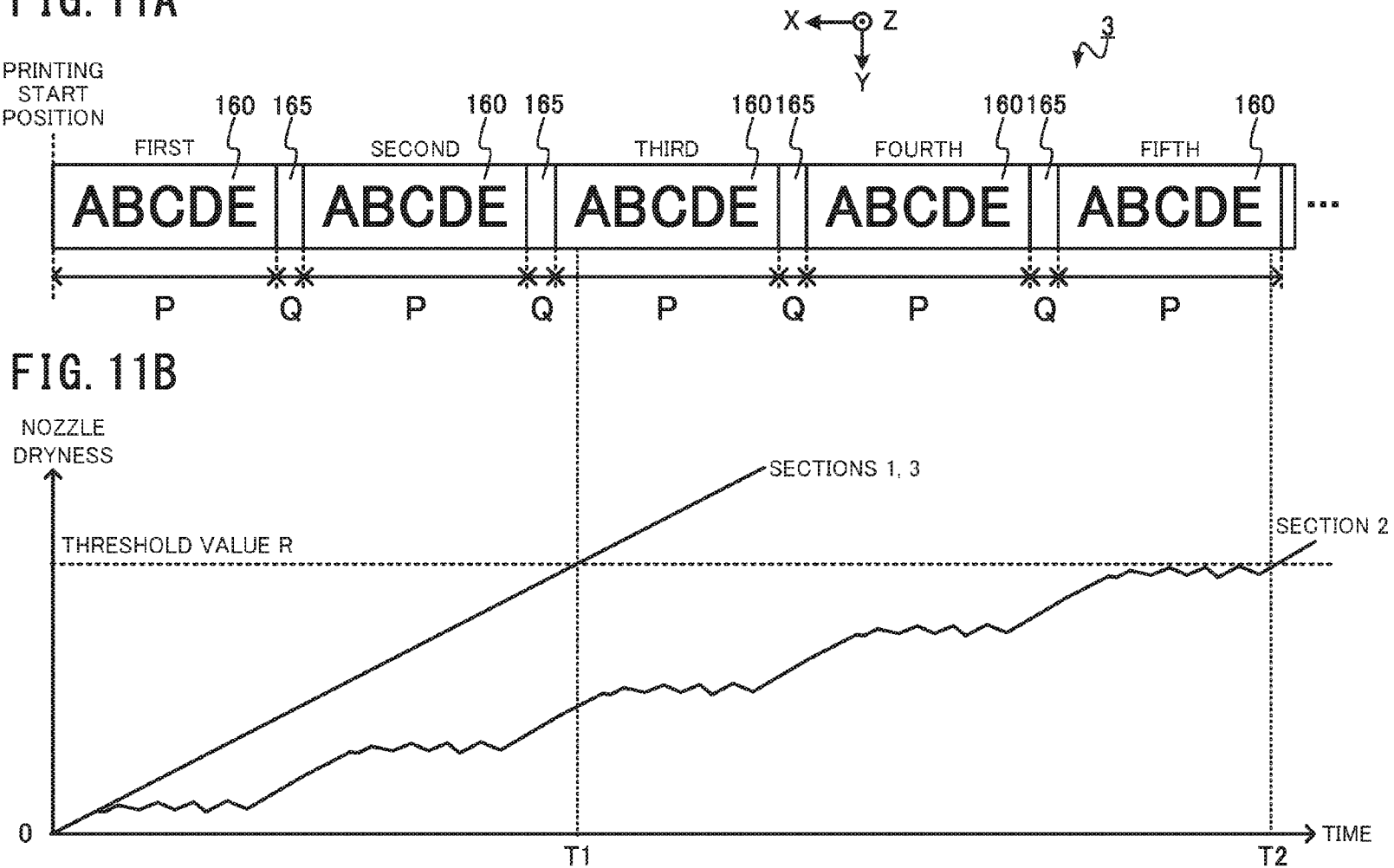
FIG. 11A is a drawing showing printing results when printing is executed across a plurality of first regions without discharging waste ink.
FIG. 11B is a drawing showing a change with time in the nozzle dryness in the case of FIG. 11A.

FIG. 11A and FIG. 11B show printing results on the tape member 3 and the change with time in the nozzle dryness during this interval, in a case in which the printing executor 105 prints the print pattern 150 over N first regions 160 without the waste ink discharger 106 discharging ink.

When the waste ink discharger 106 does not discharge ink, the printing executor 105 prints the print pattern 150 expressing the character string "ABCDE" in order from the first of the first regions 160 in the lengthwise direction of the tape member 3, as shown in FIG. 11A. The length P in the lengthwise direction of each of the first regions 160 is determined by the print data, such as the length of the character string, size of characters and type of font and/or the like expressing the print pattern 150. Determination may be made through a size indication from the user.

Each of the first regions 160 is separated from the adjacent first region 160 by a blank space of length Q. That is to say, between two adjacent first regions 160 out of the plurality of first regions 160, a second region (blank space region) 165 of length Q is provided in the lengthwise direction. The size of this blank space of length Q can be indicated by the user as one of the print settings, when sending print data to the printing apparatus 1. In addition, the length Q of the second region 165 may be determined by print data such as the length of the character string, character size, font type and/or the like expressed by the print pattern 150.

In this manner, while the printing executor 105 is executing printing across a plurality of first regions 160, the nozzle dryness of the print head 32 changes with time, as shown in FIG. 11B. To explain more concretely, the section 1 and the section 3 are sections corresponding to the blank space portion at both edges in the second direction on the tape member 3, and are sections where ink is not discharged. Consequently, that the nozzle dryness in the section 1 and the section 3 will increase proportional to the elapsed time, and will exceed a threshold value R at the point in time when a time T1 has elapsed from the start of printing, can be predicted.

In contrast, the section 2 is the section corresponding to the center portion in the second direction on the tape member 3, and is the section where ink is discharged. Consequently, the nozzle dryness in the section 2 repeatedly increases and decreases depending on the absence or presence of ink discharging. That is to say, the nozzle dryness in the section 2 has a small increase compared to the nozzle dryness in the section 1 and the section 3, and thus can be predicated to exceed the threshold value R at a point in time when a time T2 that is longer than the time T1 has elapsed from the start of printing.

The threshold value R is a value set in accordance with the extent to which the occurrence of poor discharging of ink in the print head 32 is predicted. The threshold value R is determined through experiment and/or the like, to be a value such that when the nozzle dryness exceeds this threshold value R, a high probability of nozzle clogging arising and poor discharging of ink occurring can be predicted.

That is to say, when the nozzle dryness exceeds this kind of threshold value R, a high probability that poor discharging of ink will occur in the print head 32 can be predicted. Consequently, when a prediction can be made that the nozzle dryness will exceed the threshold value R in the middle of the printing executor 105 executing printing in any of the first regions 160 out of the plurality of first regions 160, the discharge information determiner 104 determines the second region 165 between this first region and the first region 160 one in advance of this first region 160, as a region for the waste ink discharger 106 to discharge ink. That is to say, as shown in FIG. 11B, out of the nozzle dryness in a prescribed time until time T1~T2, when for example the nozzle dryness exceeds the threshold value R, the waste ink discharger 106 discharges waste ink with a timing in advance of the timing (time T1 in FIG. 11B) of the nozzle dryness exceeding the threshold value R.

To describe this more concretely, the nozzle dryness in the section 1 and the section 3 exceeds the threshold value R in the middle of printing being executed in the third first region 160, as shown in FIG. 11. Consequently, the discharge information determiner 104 determines, as the region where the waste ink discharger 106 is to discharge waste ink, the second region 165 between the third first region 160 and the second first region 160, which is the first region 160 one prior to the third first region 160. In addition, the nozzle dryness in the section 2 exceeds the threshold value R in the middle of executing printing in the fifth first region 160, as shown in FIG. 11. Consequently, the discharge information determiner 104 determines, as the region where the waste ink discharger 106 is to discharge waste ink, the second region 165 between the fifth first region 160 and the fourth first region 160, which is the first region 160 one prior to the fifth first region 160.

At this time, the discharge information determiner 104 further determines the amount of waste ink to discharge. To describe this more concretely, the discharge information determiner 104 determines as the waste ink discharge amount a volume that is larger the greater the distance between the nozzle dryness and the threshold value R. This is because when the extent to which the nozzle dryness exceeds the threshold value R is large, discharging of a large volume of waste ink and lowering the nozzle dryness are necessary.

For example, after the nozzle dryness has exceeded the threshold value R, when the time during which ink is not discharged extends over a relatively long time, the nozzle dryness further increases even after exceeding the threshold value R. Consequently, discharging a relatively large volume of waste ink is necessary in this case. In this manner, the discharge information determiner 104 scans the print data for which printing was commanded, specifies a maximum value of the nozzle dryness during printing, and increases the waste ink discharge amount the greater the difference between that maximum value and the threshold value R.

When the waste ink discharge amount is determined, the discharge information determiner 104 determines as the region where the waste ink discharger 106 is to discharge waste ink a region whose length in the lengthwise direction of the tape member 3 is longer the larger the waste ink discharge amount. This is because when waste ink is continuously discharged in the same location, the tape member 3 cannot absorb the waste ink. The discharge information determiner 104 extends the length in the lengthwise direction of the second region 165 where the waste ink is discharged the larger the waste ink discharge amount, in contrast to the length Q in the lengthwise direction of the second region 165 when waste ink is not discharged. The setting is such that the length in the lengthwise direction of the second region 165 is extended (becomes longer). Through this, discharging waste ink while conveying the tape member 3 a longer distance the larger the waste ink discharge amount is becomes possible.

When the region where the waste ink is discharged and the discharge amount (waste ink discharge information) are determined by the discharge information determiner 104 in this manner, the printing executor 105 begins printing to the plurality of first regions 160 in accordance with the print data acquired by the print data acquirer 101. At this time, the waste ink discharger 106 discharges waste ink in an amount determined by the discharge information determiner 104 in the second region 165 determined by the discharge information determiner 104.

Figures 12A, 12B:
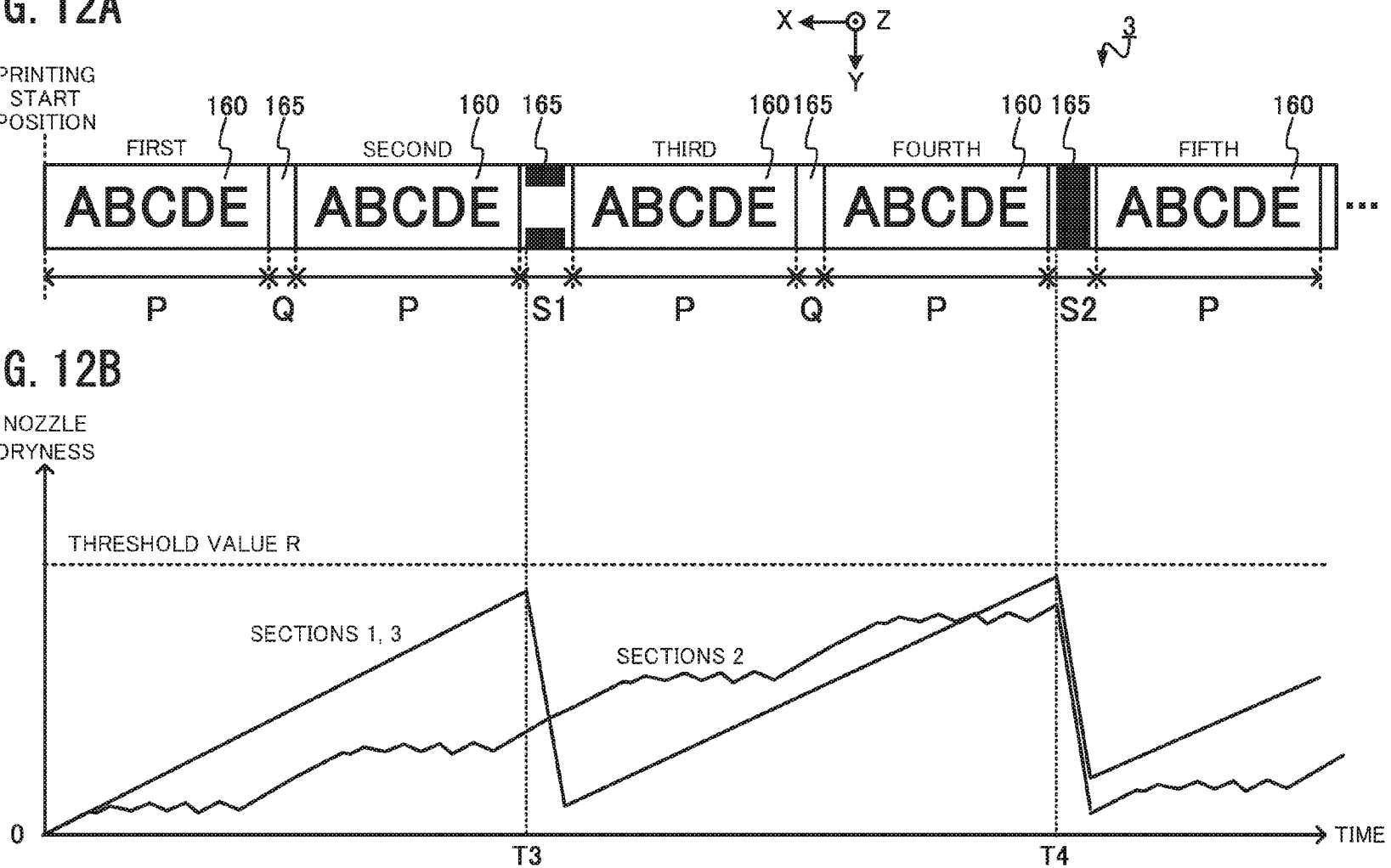
FIG. 12A is a drawing showing printing results when printing is executed by discharging waste ink in a second region.
FIG. 12B is a drawing showing a change with time in the nozzle dryness in the case of FIG. 12A.

As a result, printing results such as shown in FIG. 12A are obtained on the tape member 3. In FIG. 12A, the areas painted black indicate regions where waste ink was discharged. To describe this more concretely, in the second region 165 of length S1 in the lengthwise direction in the interval between the second first region 160 and the third first region 160, waste ink is discharged in both edge regions of the tape member 3 that are areas corresponding to the section 1 and the section 3. Furthermore, in the second region 165 of length S2 in the lengthwise direction in the interval between the fourth first region 160 and the fifth first region 160, waste ink is discharged in the areas corresponding to all three sections, that is to say across the entire width of the tape member 3.

The second region 165 in which waste ink is discharged in this manner is an area that is typically cut and discarded. Consequently, this does not have an effect on the printing desired by the user, and instead effectively utilizes blank areas of the tape member 3.

In addition, FIG. 12B shows the change with time of the nozzle dryness during this kind of printing. As shown in FIG. 12B, by discharging waste ink in the second region 165, the nozzle dryness in the section 1 and the section 3 decreases at the point in time when a time T3 has elapsed from the start of printing, and in addition, the nozzle dryness in all three sections decreases at the point in time when a time T4 has elapsed from the start of printing. As a result, in FIG. 11B the nozzle dryness exceeded the threshold value R during printing, but in FIG. 12B, the nozzle dryness is kept in the range not exceeding the threshold value R. Through this, controlling the occurrence of poor discharging of ink in the print head 32, and executing printing across a plurality of first regions 160, become possible.

The flow of the printing process executed in the printing apparatus 1 as described above is described with reference to the flowcharts shown in FIG. 13 and FIG. 14.

Figure 13:
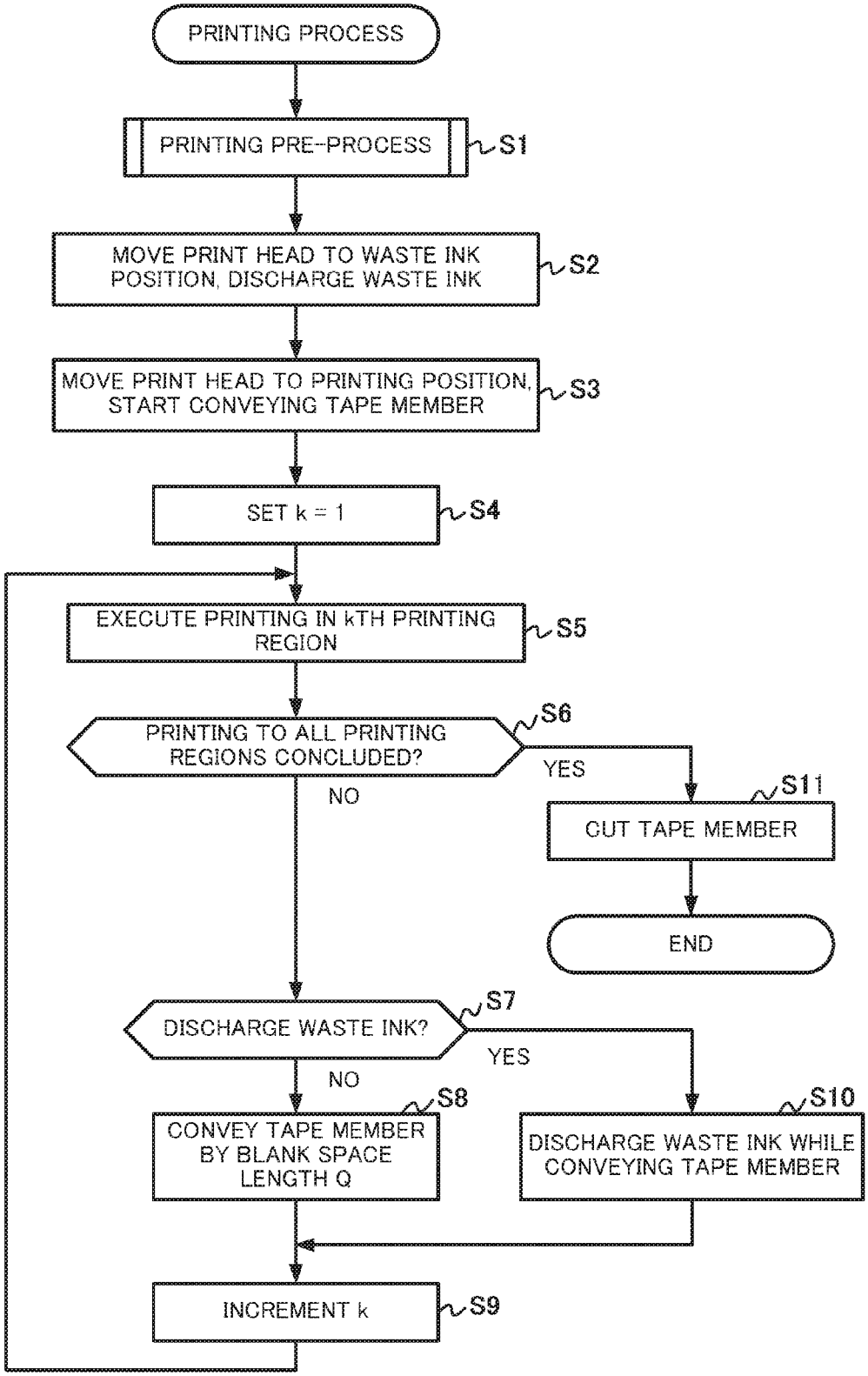
FIG. 13 is a flowchart showing a flow of a printing process executed by the printing apparatus according to the exemplary embodiment of the present disclosure.

The printing process shown in the flowchart of FIG. 13 starts when the power supply of the printing apparatus 1 is turned on and the apparatus becomes in a printable state.

Prior to the printing process shown in the flowchart of FIG. 13 beginning, the user houses (loads) the tape cartridge 11 loaded with a desired tape member 3 into the tape holder 10 in advance. When in this state the controller 2 functioning as the print data acquirer 101 acquires image data (print data) indicating the image the user desires to print on the tape member 3 and a printing start command for example via the USB control circuit 40 and/or the like from the PC 44, the printing process shown in the flowchart of FIG. 13 begins.

When the printing process begins, the controller 2 first executes a printing pre-process (step S1). Details of this printing pre-process are described with reference to the flowchart shown in FIG. 14.

Figure 14:
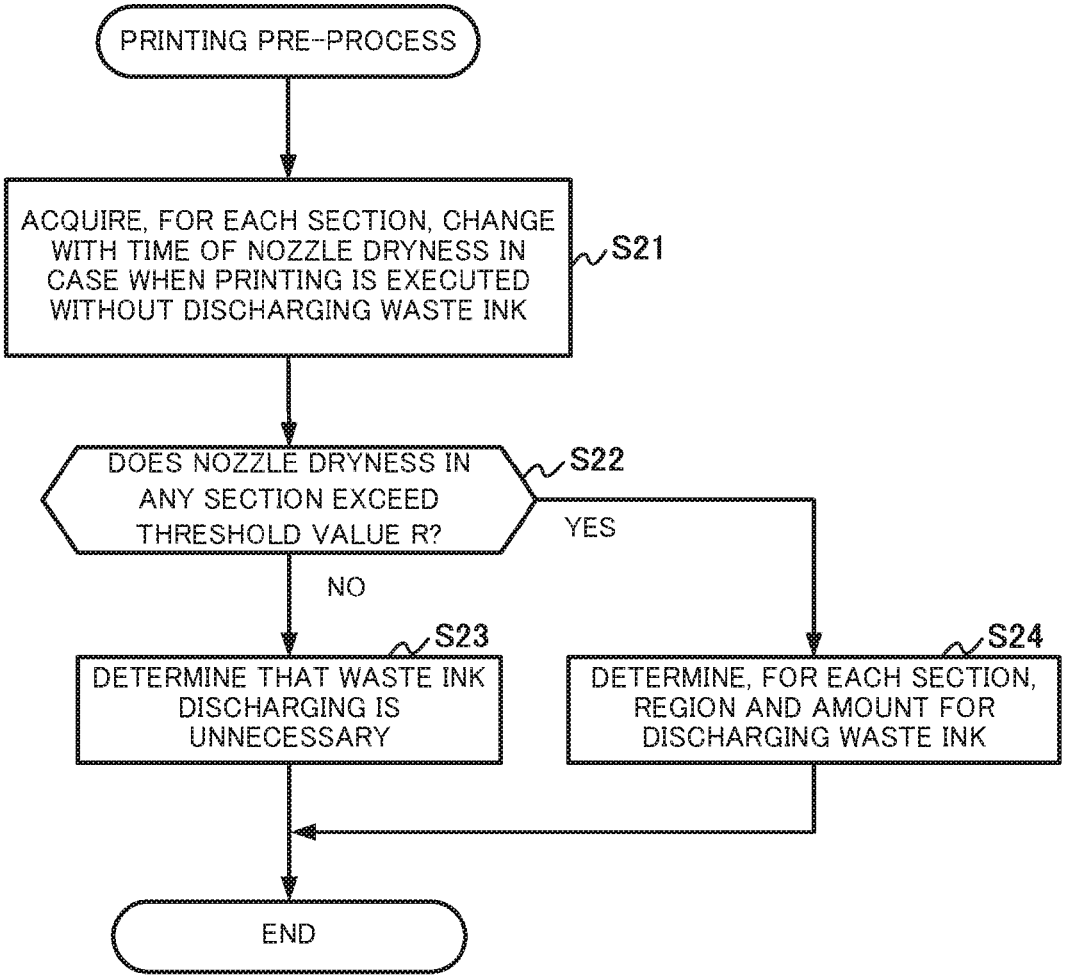
FIG. 14 is a flowchart showing a flow of a printing pre-process executed by the printing apparatus according to the exemplary embodiment of the present disclosure.

When the printing pre-process shown in the flowchart of FIG. 14 begins, the controller 2 acquires, for each section, a change with time in the nozzle dryness when printing is executed without discharging waste ink (step S21). That is to say, the controller 2 scans in advance the print data with which printing was commanded, and acquires, for each of the three sections, the change with time in the nozzle dryness in the interval from the start of printing to the end of printing, for example as shown in the graph in FIG. 11B. At this time, the controller 2 functions as the indicator value acquirer 103.

When the nozzle dryness is acquired, the controller 2 determines whether or not the nozzle dryness in any of the sections exceeds the prescribed threshold value R (step S22). When the nozzle dryness in all sections does not exceed the threshold value R (step S22: No), the assumption is made that there is a low probability that poor ink discharged will occur in the middle of the commanded printing. Accordingly, in this case the controller 2 determines that discharging of waste ink is unnecessary (step S23), and the printing pre-process shown in the flowchart of FIG. 14 ends.

In contrast, when there is even one section in which the nozzle dryness exceeds the threshold value R (step S22: Yes), the controller 2 determines the region and amount for discharging waste ink for each section in which the nozzle dryness exceeds the threshold value R (step S24). At this time, the controller 2 functions as the discharge information determiner 104.

To describe this more concretely, the controller 2 determines the second region 165 in advance of the nozzle dryness exceeding the threshold value R as the region for discharging waste ink, so that the nozzle dryness does not exceed the threshold value R. In addition, an amount that is larger the greater the extent to which the nozzle dryness exceeds the threshold value R is determined as the amount of waste ink discharge. Furthermore, the controller 2 determines, as the region for discharging the waste ink, a region the length of which in the lengthwise direction of the tape member 3 is longer the larger the amount of waste ink to be discharged, so that the tape member 3 can absorb the waste ink. Through the above, the printing pre-process shown in the flowchart of FIG. 14 ends.

In the printing process shown in the flowchart of FIG. 13, when the printing pre-process shown in step S1 ends, the controller 2 causes the print head 32 to move to the waste ink position and discharges waste ink (step S2).

To describe this more concretely, prior to the start of printing, the ink carriage 30 is in a print standby position such as that shown in FIG. 1, and the ink discharge opening of the print head 32 is covered by the cap 37. In this state, the controller 2 causes the stepping motor 36 to move via the carriage control circuit 53 and causes the ink carriage 30 to move to a waste ink position that is a position directly over the waste ink receptacle 38, as shown in FIG. 5. In addition, the controller 2 controls the print head 32 via the ink discharge control circuit 52 and discharges (spits) waste ink from the print head 32 to the waste ink receptacle 38. Through this, ink near the discharge opening that could cause poor ink discharge due to hardening or solidifying during printing standby is removed, and the nozzle is cleaned. Consequently, the state of the print head 32 becomes an optimal state for executing printing.

When the waste ink is discharged to the waste ink receptacle 38, the controller 2 causes the print head 32 to move to the printing position and starts conveyance of the tape member 3 (step S3).

To describe this more concretely, when waste ink is discharged from the print head 32 in the waste ink position, the controller 2 causes the stepping motor 36 to be driven via the carriage control circuit 53, and causes the ink carriage 30 to be moved to above the tape conveyance path, as shown in FIG. 4. Furthermore, the controller 2 causes the stepping motor 21 and the platen roller 22 and/or the like to be driven via the tape conveyance control circuit 51, and starts conveyance of the tape member 3 housed in the tape holder 10. At this time, the controller 2 functions as the tape conveyor 102.

When conveyance of the tape member 3 starts, the controller 2 sets (initializes) to 1 the value of a counter variable k indicating which number printing the printing currently being executed is (step S4), and the process proceeds to the main process of printing to the tape member 3.

When the value of the variable k is initialized to 1, the controller 2 executes printing in the kth first region 160 of the tape member 3 while conveying the tape member 3 (step S5). That is to say, the controller 2 controls the print head 32 via the ink discharge control circuit 52, and by discharging ink from the print head 32, prints the print pattern for which printing was commanded, on the printing surface of the conveyed tape member 3. For example, when printing begins, the value of k is set to 1, so the controller 2 executes printing in the initial (first) first region 160 of the tape member 3. At this time, the controller 2 functions as the printing executor 105.

When a command to print the print pattern 150 of "ABCDE" of length P as shown in FIG. 8, for example, in N first printing regions 160 on the tape member 3 is received, the controller 2 prints the print pattern 150 in the kth first region 160 while conveying the tape member 3 by a distance P.

When printing to the kth first region 160 ends, the controller 2 determines whether or not printing to all first regions 160 has ended (step S6). When for example execution of printing on N first regions 160 is commanded, the controller 2 determines whether or not printing to all first regions 160 has ended by determining whether or not the value of the counter variable k has reached N.

When printing to all first regions 160 has not ended (step S6: No), the controller 2 determines whether or not to discharge waste ink prior to printing to the next first region 160 (step S7). That is to say, the controller 2 determines whether or not conveyance of the tape member 3 has reached the second region 165 where discharging of waste ink is necessary, on the basis of the waste ink discharge information determined in the printing pre-process of step S1.

When waste ink is not to be discharged prior to printing to the next first region 160 (step S7: No), the controller 2 conveys the tape member 3 by the predetermined blank space length Q without discharging waste ink (step S8). Then, the controller 2 increments the value of the counter variable k (step S9), returns the process to step S5 and executes printing to the next first region 160.

On the other hand, when waste ink is to be discharged prior to printing to the next first region 160 in step S7 (step S7: Yes), the controller 2 discharges waste ink while conveying the tape member 3 over the length of the second region 165 in which waste ink is discharged (step S10). At this time, the controller 2 functions as the waste ink discharger 106. Then, the controller 2 increments the value of the counter variable k (step S9), returns the process to step S5 and executes printing to the next first region 160.

In this manner, the controller 2 discharges waste ink in the second region 165 determined in the printing pre-process of step S1, out of the second regions 165 between two adjacent first regions 160, while executing printing to a plurality of first regions 160 on the conveyed tape member 3. Through this, the controller 2 executes printing over a plurality of first regions 160 while controlling the occurrence of poor discharging of ink in the print head 32.

While executing the printing process and waste ink discharge process while conveying the tape member 3 in this manner, when the front edge or back edge of each of the first regions 160 has reached the position of the full-cut mechanism 17 or the half-cut mechanism 18, the controller 2 controls the full-cut mechanism 17 or the half-cut mechanism 18 and cuts the tape member 3. Through this, a plurality of labels on which the desired print pattern has been printed is successively created. Which of the full-cut mechanism 17 or the half-cut mechanism 18 is used can be changed by the user through settings.

Finally, when printing to all first regions 160 ends (step S6: Yes), the controller 2 cuts the tape member 3 with the full-cut mechanism 17 at the printing end position of the print pattern that was printed last (step S11), and ends the printing process. Through this, the printing process shown in the flowchart of FIG. 13 concludes.

As described above, the printing apparatus 1 according to the present application, when executing printing over a plurality of first regions 160, discharges waste ink in second regions 165 between two adjacent first regions 160 out of the plurality of first regions 160, so that poor discharging of ink does not occur in the print head 32. As a result, waste ink can be discharged without moving the print head 32 from the printing position, so high-speed printing is possible while controlling poor discharging of ink. In particular, when executing lengthy printing such as when executing printing continuously over a plurality of first regions 160, print time can be greatly shortened. Furthermore, in the printing apparatus 1 that executes inkjet printing using a single-pass method, the effect is particularly pronounced because characteristically deterioration of print quality caused by nozzle clogging readily occurs.

(Variation)

An exemplary embodiment of the present disclosure was described above, but the above-described exemplary embodiment is one example and the scope of applications of the present disclosure is not limited thereby. That is to say, various applications of the exemplary embodiment of the present disclosure are possible, and all embodiments are included within the scope of the present disclosure.

For example, in the above-described exemplary embodiment, the printing apparatus 1 prints the print pattern 150 expressing the character string "ABCDE" in N first regions 160 on the tape member 3. However, the print pattern the printing apparatus according to the present disclosure prints may be any kind of pattern including text, symbols, graphics, images and/or the like. In addition, the printing apparatus according to the present disclosure may print differing print patterns rather than the same print pattern in the plurality of first regions on the tape member 3.

In addition, in the above-described exemplary embodiment, the indicator value acquirer 103 acquired the nozzle dryness separated into three sections. However, with the present disclosure, the indicator value acquirer 103 may acquire the nozzle dryness as an indicator value for predicting the occurrence of poor discharging of ink divided into any number of sections. For example, the nozzle dryness may be acquired for each nozzle. When the sections become larger in number, the number of nozzle dryness values that should be acquired increases so the amount of computation for acquiring the nozzle dryness increases, but the precision of predicting the occurrence of poor discharging of ink improves.

In addition, with the above-described exemplary embodiment, when a prediction is made that nozzle dryness will exceed the threshold value R while the printing executor 105 is executing printing in a first region 160 out of the plurality of first regions 160, the discharge information determiner 104 determines, as a region in which the waste ink discharger 106 discharges waste ink, a second region 165 between this first region 160 and the first region one prior to this first region 160. However, with the present disclosure, the second region 165 where waste ink is discharged is not limited to being the second region 165 immediately prior to the nozzle dryness exceeding the threshold value R. For example, discharging waste ink divided over a plurality of second regions 165 is possible. In addition, when discharging waste ink in any of the sections out of the three sections, waste ink may also be discharged in another section simultaneously. In this manner, the discharge information determiner 104 can appropriately optimize determination of the second region 165 where waste ink is discharged in each of the three sections.

In addition, with the above-described exemplary embodiment, the printing apparatus 1 comprised the indicator value acquirer 103 and the discharge information determiner 104. That is to say, the printing apparatus 1 according to the above-described exemplary embodiment acquired the nozzle dryness and determined the region and amount for discharging waste ink (waste ink discharge information) internally. However, the printing apparatus according to the present disclosure need not comprise the indicator value acquirer 103 and the discharge information determiner 104, and instead may be such that external equipment such as a PC 44 and/or the like that generates print data is equipped with functions corresponding to the indicator value acquirer 103 and the discharge information determiner 104 as one part of the functions of the printer driver, for example. That is to say, the functions of the indicator value acquirer 103 and the discharge information determiner 104 may be provided in either the printing apparatus or external equipment.

In this case, the external equipment, along with generating print data, determines the region and amount for discharging waste ink (waste ink discharge information) so that poor discharging of ink does not occur in the print head when the printing apparatus is executing printing with this print data. The printing apparatus comprises an information acquisition means, and this information acquisition means acquires from the external equipment waste ink discharge information indicating the amount of ink to be discharged and the region where the waste ink is to be discharged, as determined in the external equipment. This kind of information acquisition means is realized by the controller 2 working together with the USB control circuit 40, the Bluetooth® module/WLAN module 41 and/or the like. Furthermore, when the information acquisition means acquires the waste ink discharge information, the ink discharge means discharges ink in the amount indicated by the acquired waste ink discharge information from the print head in the second region indicated by the waste ink discharge information acquired by the information acquisition means.

In addition, the external equipment that generates and transmits to the print apparatus 1 print data and waste ink discharge information is not limited to the PC 44, but may be an appropriate terminal device such as a smartphone, tablet computer and/or the like.

In addition, in the above-described exemplary embodiment, the printing apparatus 1 comprised a print data acquirer 101 and acquired print data from the PC 44, which is a standalone external device. However, the printing apparatus according to the present disclosure need not acquire print data from an external device. For example, the printing apparatus may store print data in a memory in the apparatus and acquire print data from this memory.

By making application so that a program for causing the realization of various functional configurations capable of providing, as a printing apparatus prepared in advance, a configuration for realizing functions according to the present disclosure can be executed by a CPU (controller) and/or the like for controlling an existing information processing apparatus and/or the like, an existing information processing apparatus can be caused to function as the printing apparatus according to the present disclosure. In addition, the printing control method according to the present disclosure can be implemented using the printing apparatus.

In addition, application methods of this kind of program are arbitrary. The program can be stored and applied, for example, on a non-transitory computer-readable recording medium such as a flexible disk, a compact disc (CD-ROM), a digital versatile disc (DVD-ROM), a memory card and/or the like. Furthermore, the program can be overlaid on carrier waves and applied via a communication medium such as the Internet. For example, the program may be posted and distributed on a bulletin board system (BBS) on a communication network. Furthermore, the configuration may also be such that the above-described processes can be executed by activating the program and executing the program similar to other application programs, under control of an operating system (OS).

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing control method for a printing apparatus that includes a controller, such that the controller:

sets a plurality of first regions along a first direction on a print medium that is conveyed, and a plurality of second regions, each disposed between two first regions of the plurality of first regions, on the basis of print data; and executes printing by causing ink to be discharged from a print head to the plurality of first regions so as to print on the basis of the print data and acquires on the basis of the print data an indicator value for predicting poor discharging of ink in the print head in cases when printing is executed, in advance of the start of printing;

determines a specified second region among the plurality of second regions in which ink is to be discharged from the print head and determines an amount of ink to be discharged from the ink head to the specified second region; and discharges ink in the determined amount from the print head to the specified second region.

2. The printing control method according to claim 1, wherein the controller extends the length of the second region in the first direction the larger the determined amount of ink to be discharged in the specified second region is.

3. The printing control method according to claim 1, wherein the controller sets, as the indicator value, a value that decreases when ink is discharged from the print head and increases when ink is not discharged from the print head, during execution of printing.

4. The printing control method according to claim 1, wherein the controller:

repeatedly acquires the indicator value during a prescribed time interval, when printing is executed across the plurality of first regions without discharging ink in the second region; and when a prediction is made, prior to actually executing printing, that the indicator value will exceed a prescribed threshold value in the middle of executing printing in a first region of the plurality of first regions, determines as the specified second region a region between the first region and an another first region one in advance of the first region.

5. The printing control method according to claim 1, wherein when a prediction is made, prior to actually executing printing, that the indicator value will exceed a prescribed threshold value in the middle of executing printing in a first region of the plurality of first regions, the controller determines as the amount of ink to be discharged in the specified second region an amount that is greater the larger the difference is between the indicator value and the threshold value.

6. The printing control method according to claim 1, wherein when a prediction is made, prior to actually executing printing, that the indicator value will exceed a prescribed threshold value in the middle of executing printing in a first region of the plurality of first regions, and when a time during which the ink is not discharged after the threshold value is exceeded is at least as great as a prescribed time, the controller determines a prescribed amount of the ink as the amount of ink to be discharged in the specified second region.

7. The printing control method according to claim 1, wherein the controller:

acquires the indicator value for each of a plurality of sections in the printing medium, divided in a second direction orthogonal to the first direction of the printing medium; and determines the specified second region and the amount of ink to be discharged in the specified second region for each of the plurality of sections, on the basis of the indicator value acquired for each of the plurality of sections.

8. A printing apparatus comprising:

a print head; and a controller;

wherein the controller:

sets a plurality of first regions along a first direction on a print medium that is conveyed, and a plurality of second regions, each disposed between two first regions of the plurality of first regions, on the basis of print data; and executes printing by causing ink to be discharged from the print head to the plurality of first regions so as to print on the basis of the print data and acquires on the basis of the print data an indicator value for predicting poor discharging of ink in the print head in cases when printing is executed, in advance of the start of printing;

determines a specified second region among the plurality of second regions in which ink is to be discharged from the print head and determines an amount of ink to be discharged from the ink head to the specified second region; and discharges ink in the determined amount from the print head to the specified second region.

9. The printing apparatus according to claim 8, wherein the controller extends the length of the second region in the first direction the larger the determined amount of ink to be discharged in the second region is.

10. The printing apparatus according to claim 8, wherein the controller sets, as the indicator value, a value that decreases when ink is discharged from the print head and increases when ink is not discharged from the print head, during execution of printing.

11. The printing apparatus according to claim 8, wherein the controller:

repeatedly acquires the indicator value during a prescribed time interval, when printing is executed across the plurality of first regions without discharging ink in the second region; and when a prediction is made, prior to actually executing printing, that the indicator value will exceed a prescribed threshold value in the middle of executing printing in a first region of the plurality of first regions, determines as the specified second region a region between the first region and an another first region one in advance of the first region.

12. The printing apparatus according to claim 8, wherein the controller:

acquires print data from a standalone external device;

acquires information indicating the specified second region and the amount of ink to be discharged in the specified second region, from the external device; and executes printing in accordance with the print data and discharge ink in an amount indicated by the information, from the print head, to the specified second region indicated by the information.

13. A non-transitory computer-readable memory medium for controlling a printing apparatus comprising a controller, the memory medium causing the following to be accomplished:

a process that sets a plurality of first regions along a first direction on a print medium that is conveyed, and a plurality of second regions, each disposed between two first regions of the plurality of first regions, on the basis of print data; and a process that executes printing by causing ink to be discharged from a print head to the plurality of first regions so as to print on the basis of the print data and acquires on the basis of the print data an indicator value for predicting poor discharging of ink in the print head in cases when printing is executing, in advance of the start of printing;

a process that determines a specified second region among the plurality of second regions in which ink is to be discharged from the print head and determines an amount of ink to be discharged from the ink head to the specified second region; and a process that discharges ink in the determined amount from the print head to the specified second region.

14. The non-transitory computer-readable memory medium according to claim 13, further containing:

a process for extending the length of the specified second region in the first direction the larger the determined amount of ink to be discharged in the specified second region is.

15. The non-transitory computer-readable memory medium according to claim 13, further containing:

a process for repeatedly acquiring the indicator value during a prescribed time interval, when printing is executed across the plurality of first regions without discharging ink in the second region; and a process that, when a prediction is made, prior to actually executing printing, that the indicator value will exceed a prescribed threshold value in the middle of executing printing in a first region of the plurality of first regions, determines as the specified second region a region between the first region and an another first region one in advance of the first region.

16. A printing control method for a printing apparatus that includes a controller, such that the controller:

sets a plurality of first regions along a first direction on a print medium that is conveyed, and a plurality of second regions, each disposed between two first regions of the plurality of first regions, on the basis of print data; and executes printing by causing ink to be discharged from a print head to the plurality of first regions so as to print on the basis of the print data and acquires on the basis of the print data an indicator value for predicting poor discharging of ink in the print head in cases when printing is executed, in advance of the start of printing;

determines a specified second region among the plurality of second regions in which ink is to be discharged from the print head; and discharges ink from the print head to the specified second region.

17. A printing apparatus comprising:

a print head; and a controller;

wherein the controller:

sets a plurality of first regions along a first direction on a print medium that is conveyed, and a plurality of second regions, each disposed between two first regions of the plurality of first regions, on the basis of print data; and executes printing by causing ink to be discharged from the print head to the plurality of first regions so as to print on the basis of the print data and acquires on the basis of the print data an indicator value for predicting poor discharging of ink in the print head in cases when printing is executed, in advance of the start of printing;

determines a specified second region among the plurality of second regions in which ink is to be discharged from the print head; and discharges ink from the print head to the specified second region.

* * * * *